US010258997B2

(12) United States Patent
Zhang et al.

(10) Patent No.: US 10,258,997 B2
(45) Date of Patent: Apr. 16, 2019

(54) DEVICE AND A METHOD FOR PREPARING ANALYSIS SAMPLES USING SELECTIVE MODES OF VIBRATIONAL OSCILLATIONS AND CENTRIFUGAL ROTATIONS

(71) Applicant: BEIJING ABILITY TECHNOLOGY CO., LTD., Beijing (CN)

(72) Inventors: Dongming Zhang, Beijing (CN); Shanshan Zhang, Beijing (CN); Yuemeng Liu, Beijing (CN)

(73) Assignee: BEIJING ABILITY TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/561,298

(22) PCT Filed: Aug. 11, 2016

(86) PCT No.: PCT/CN2016/094635

§ 371 (c)(1),
(2) Date: Sep. 25, 2017

(87) PCT Pub. No.: WO2017/041607

PCT Pub. Date: Mar. 16, 2017

(65) Prior Publication Data

US 2018/0200732 A1 Jul. 19, 2018

(30) Foreign Application Priority Data

Sep. 11, 2015 (CN) ..... 2015 1 0579053

(51) Int. Cl.
*B01F 9/00* (2006.01)
*B04B 5/04* (2006.01)
(Continued)

(52) U.S. Cl.
CPC ..... *B04B 5/0421* (2013.01); *B01F 11/0014* (2013.01); *B04B 9/08* (2013.01); *B04B 9/12* (2013.01); *B01F 9/0003* (2013.01)

(58) Field of Classification Search
CPC B04B 9/10; B04B 5/0421; B04B 9/12; B04B 9/08; B01F 15/00805;
(Continued)

(56) References Cited

U.S. PATENT DOCUMENTS 5,045,047 A * 9/1991 Hutchins ..... B04B 5/02 494/17
5,567,050 A * 10/1996 Zlobinsky ..... B01F 11/0008 366/110
(Continued)

FOREIGN PATENT DOCUMENTS

CN 105115809 A * 12/2015
CN 205091174 U * 3/2016

*Primary Examiner* — Charles Cooley
(74) *Attorney, Agent, or Firm* — SV Patent Service

(57) ABSTRACT

A device provides selective modes of vibrational oscillations and centrifugal rotations for preparing analysis samples. The device includes a base, an elastic connection body, a group of a synchronous unidirectional bearing inner ring and a synchronous unidirectional bearing outer ring, a group of an eccentric unidirectional bearing inner ring and an eccentric unidirectional bearing outer ring, and a synchronous fixed ring and a motor on the base. The eccentric unidirectional bearing outer ring is connected to a sample plate for holding the analysis samples.

7 Claims, 2 Drawing Sheets

(51) Int. Cl.
*B04B 9/08* (2006.01)
*B04B 9/12* (2006.01)
*B01F 11/00* (2006.01)

(58) Field of Classification Search
CPC .... B01F 15/0237; B01F 3/12; B01F 11/0025; B01F 15/0295; B01F 11/0275; B01F 9/0003; B01F 11/0017; B01F 11/0014; G01N 1/34
See application file for complete search history.

(56) References Cited

U.S. PATENT DOCUMENTS

| | | | | |
|---|---|---|---|---|
| 5,769,538 | A * | 6/1998 | Sherman | B01F 11/0008 366/198 |
| 7,204,637 | B2 * | 4/2007 | Sherman | B01F 9/0021 366/214 |
| 10,010,837 | B2 * | 7/2018 | Meles | B01F 11/0005 |
| 2005/0277538 | A1 * | 12/2005 | Sherman | B01F 9/0021 494/16 |
| 2008/0318755 | A1 * | 12/2008 | Yamada | B04B 5/0421 494/9 |
| 2015/0003183 | A1 * | 1/2015 | Meles | B01F 11/0005 366/110 |
| 2015/0005150 | A1 * | 1/2015 | Meles | B04B 9/10 494/9 |
| 2018/0104684 | A1 * | 4/2018 | Kunbargi | B01F 9/0003 |
| 2018/0200732 | A1 * | 7/2018 | Zhang | B04B 5/0421 |

* cited by examiner

DEVICE AND A METHOD FOR PREPARING ANALYSIS SAMPLES USING SELECTIVE MODES OF VIBRATIONAL OSCILLATIONS AND CENTRIFUGAL ROTATIONS

TECHNICAL FIELD

The present invention relates to an analytical sample preparation apparatus, and more particularly, to an apparatus, which can prepare analytical samples with oscillation and centrifugal coupling.

BACKGROUND OF THE INVENTION

The analytical sample preparation process typically involves extraction and clean-up steps: the purpose of the extraction is to transfer components of a sample to a liquid as much as possible to obtain the so-called extract; and the clean-up is to separate the to-be-analyzed components from other components in the extract. The most basic clean-up step is to remove the remaining samples in the extract, which is usually done in a centrifugal manner. The most important step in the extraction process is to thoroughly mix the solids and the liquid to transfer components from the solids to the liquid. The mixing can be achieved in many ways, such as ultrasonic extraction, microwave extraction, and mechanical oscillatory extraction, wherein the mechanical oscillation is the most widely used. The centrifugation method uses high-speed rotation and the centrifugal forces to achieve separation, which is also a purely mechanical method. In most cases, the oscillation and centrifugation involve very different operations, which require different devices, and would not only increase cost, but also require very inconvenient sample transfer. If the two functions can be jointly implemented in a same mechanical device, the analysis sample preparations may be greatly simplified, and their efficiency substantially increased.

At present, there has been report about the use of stepper motor to accomplish oscillation and centrifugal functions. The implementation method includes using a stepper motor as a driving source to produce reciprocating actions at a certain frequency and amplitudes to achieve oscillation, and one-way rotations to achieve centrifugation. This method can only achieve planar oscillations, with their frequencies and angles significantly limited by the performance of the stepper motors, resulting in insufficient vibrations. In addition, the stepper motors have small load capacities, low one-way rotation speed. As a result, the sample processing and the centrifugal speeds cannot fully satisfy the requirements for preparing analytical samples.

SUMMARY OF THE INVENTION

In view of the technical problems existing in the conventional technologies, the present disclosure provides a new device for oscillation and centrifugal coupling, which can accomplish oscillation and centrifugal coupling in the same mechanical device, which greatly simplifies the preparation process of analysis samples and greatly improves the efficiency.

The present invention includes the following technical features:

An analytical sample preparation device, includes a base 1, an elastic connection body 5, a group of a synchronous unidirectional bearing inner ring 41 and a synchronous unidirectional bearing outer ring 42, a group of an eccentric unidirectional bearing inner ring 61 and an eccentric unidirectional bearing outer ring 62, and a synchronous fixed ring 2 and a motor 31 on the base 1, wherein the motor 31 is positioned within a synchronous fixed ring 2, wherein one end of the synchronous fixed ring 2 is fixed to the synchronous unidirectional bearing inner ring 41, wherein the synchronous unidirectional bearing outer ring 42 is connected to a lower end of the elastic connection body 5, wherein the eccentric unidirectional bearing inner ring 61 is connected with an eccentric shaft 32 extending from a motor 31, wherein the eccentric unidirectional bearing outer ring 62 is fixed to an eccentric shaft sleeve 9 that is fixed to a sample tray 7 and an upper end of the elastic connection body 5, wherein the eccentric shaft sleeve 9, the eccentric shaft 32, the eccentric unidirectional bearing inner ring 61, and the eccentric unidirectional bearing outer ring 62 have their center of mass disposed on a line extended from the center line of the motor 31, wherein the eccentric unidirectional bearing inner ring 61 and the eccentric unidirectional bearing outer ring 62 can only rotate in direction A, wherein the synchronous unidirectional bearing outer ring 41 and the synchronous unidirectional bearing outer ring 42 can only rotate in a direction opposite to direction A.

Further, the angle between the eccentric shaft 32 and the line extended from the centerline of the motor 31 is between 1° and 10°.

Further, an upper end of the elastic connection body 5 is connected with a lower end of the eccentric shaft sleeve 9, wherein the sample tray 7 is fixedly connected to the upper end of the eccentric shaft sleeve 9.

Further, the direction A can be clockwise or counterclockwise.

A method for preparing analytical samples using the analytical sample preparation device, includes:

1) placing a sample tube containing the samples and extracts into the sample tray 7;

2) setting the motor 31 to rotate in direction A for a first predetermined time, wherein the motor 31 drives the eccentric unidirectional bearing inner ring 61 to rotate relative to the eccentric unidirectional bearing outer ring 62, which causes the elastic connection body 5 to drive the sample tube to oscillate, thereby achieving extraction of the sample by vibration; and 3) when the vibration is finished, setting the motor 31 to rotate in the direction opposite to direction A for a second predetermined time, wherein the motor 31 drives the synchronous unidirectional bearing inner ring 41 to rotate relative to the synchronous unidirectional bearing outer ring 42, which causes the elastic connection body 5 to drive the sample tube to oscillate, thereby achieving separation of the sample from the extract in the sample tube.

Further, the method includes adjusting the first predetermined time and the second predetermined time; and repeating step 2) and step 3) one or more times to achieve sample separation from the extract in the sample tube.

Further, the method includes placing a plurality of sample tubes symmetrically on the sample tray.

The presently disclosed device structure is schematically illustrated in FIG. 1, wherein a synchronous fixed ring 2 and a motor 31 are respectively fixed on a base 1. A synchronous fixed ring 2 is associated with a synchronous unidirectional bearing inner ring 41 and serves as a support and a fixed action. A synchronous unidirectional bearing outer ring 42 is connected to an elastic connection body 5. As shown in FIG. 1, when the motor 31 is rotated in direction A (which can be clockwise or counterclockwise), the synchronous unidirectional bearing inner ring 41 and the synchronous unidirectional bearing outer ring 42 have a great resistance, which is similar to a locked relationship. When the motor 31 is rotated in a direction opposite to direction A, the synchronous unidirectional bearing inner ring 41 and the synchronous unidirectional bearing outer ring 42 are similar to a conventional bearing: the resistance is extremely small and can be displaced arbitrarily therebetween. The eccentric shaft 32 is extended from the motor 31, and the upper portion of the eccentric shaft 32 deviates from the centerline of the motor 31, exhibiting an angle between 1° and 10°. The upper portion of the eccentric shaft 32 is fixedly coupled to the eccentric unidirectional bearing inner ring 61. The eccentric unidirectional bearing outer ring 62 is fixedly coupled to the eccentric sleeve 9 (the sleeve fitted with the eccentric shaft). When the motor 31 is rotated in the direction A, the eccentric unidirectional bearing rotates between the eccentric unidirectional bearing inner ring 61 and the eccentric unidirectional bearing outer ring 62 at an extremely small resistance and can be displaced arbitrarily there between. When the motor 31 is rotated opposite to direction A, the resistance between the eccentric unidirectional bearing inner ring 61 and the eccentric unidirectional bearing outer ring 62 is extremely large, similar to the locked relationship. The eccentric sleeve 9 is fixedly coupled to the sample tray 7; the eccentric sleeve 9 and the sample tray 7 are respectively fixedly connected to the elastic connection body 5, or the three components are fixedly co-coupled together. The mass of the eccentric sleeve 9 is so adjusted that when the sample tray 7 coupled thereto is perpendicular to the center line of the motor 31, the center of mass of the eccentric shaft 32, the eccentric unidirectional bearing inner ring 61, the eccentric unidirectional bearing outer ring 62 and the eccentric sleeve 9 falls on a line extended from the center line of the motor 31. Sample tubes 8 are symmetrically mounted on the sample tray 7. Samples 81 and extracts 82 are placed in the sample tubes 8.

The sample 81 and the extract 82 are placed in the sample tube 8 during operation and placed on the sample tray 7. Thereafter, the starting motor 31 is rotated in direction A (A can be clockwise or counterclockwise) to start the vibration extraction, and the equivalent structure thereof is schematically shown in FIG. 2. At this time, the resistance is extremely small between the eccentric unidirectional bearing inner ring 61 and the eccentric unidirectional bearing outer ring 62, which is similar to the conventional bearing; the two rings can be displaced at any location. In FIG. 2, the ordinary bearing represents an equivalent eccentric coupling bearing 63, whereas the resistance between the synchronous unidirectional bearing inner ring 41 and the synchronous unidirectional bearing outer ring 42 is extremely large, similar to the locked relationship, which is equivalent to the fixed coupling in FIG. 2. As shown in the equivalent schematic in FIG. 2, under this condition, the eccentric sleeve 9 is locked by the elastic connection body 5 that is fixedly connected to the base 1 by the synchronizing fixed ring 2. Therefore, when the motor 31 is rotated in direction A, the eccentric sleeve 9 cannot rotate with the motor eccentric shaft 32 and can only exhibit a 8-shaped wobble under the action of the equivalent eccentric coupling bearing 63, which generating a stimulating vibration force. Under the constraint of the elastic connection body 5, the stimulating vibration force generates 8-shaped vibrations oscillations at certain frequency in the eccentric sleeve 9 and the sample tube 8 mounted on the sample tray 7. As a result, the sample 81 and the extract 82 are driven to oscillate vigorously to be uniformly mixed in the sample tube 8, which accomplish extraction of the sample.

Referring to the equivalent structure in FIG. 3, when the vibration process is completed, the control motor 31 stops at a pre-set position so that the plane of the sample tray 7 is perpendicular to the centerline of the motor 31. Then the motor 31 starts to rotate opposite to direction A to start centrifugal separation. The eccentric unidirectional bearing inner ring 61 and the eccentric unidirectional bearing outer ring 62 are extremely resistant, similarly to a locked relationship, equivalent to the fixed coupling as shown in FIG. 3. As a result, the eccentric shaft 32, the eccentric sleeve 9 and the elastic connection body 5 are equivalent to a unitary body—an equivalent shaft coupling body 33 in FIG. 3. At this position, the eccentric shaft 32, the eccentric unidirectional bearing inner ring 61, the eccentric unidirectional bearing outer ring 62, and the eccentric sleeve 9 have their combined the center of mass falls on a line extended from the center of the motor 31. Equivalently, the centroid of the equivalent shaft coupling body 33 in FIG. 3 also falls on the extension of the centerline of the motor 31. The synchronous unidirectional bearing inner ring 41 and the synchronous unidirectional bearing outer ring 42 are similar to a conventional bearing; the resistance is extremely small. The two rings can be displaced at any position at will, which is represented by an equivalent synchronous coupling bearing 43 (an ordinary bearing) shown in FIG. 3. As shown in the equivalent structure in FIG. 3, when the motor is rotated in the direction opposite to direction A, the equivalent shaft coupling body 33, following the motor 31, rotates in the direction opposite to direction A. The equivalent resonant coupling bearing 43 (e.g. an ordinary bearing) connected to the synchronous fixed ring 2 does not obstruct its movement of the equivalent shaft coupling body 33. Since the center of mass of the equivalent shaft coupling body 33 falls on the center line extension line of the motor 31, mass balance is maintained in the rotation opposite to direction A; the rotation can run smoothly at a high speed. Under this condition, the equivalent shaft coupling body 33 brings along the sample tray 7 connected thereto and the sample tube 8 mounted thereon to rotate at a high speed to produce a corresponding centrifugal force, which causes the sample 81 in the sample tube 8 and the extract 82 to separate by centrifugation.

Compared with conventional technologies, the present invention includes the following advantageous effects:

According to the above description, the disclosed structure accomplishes oscillating and centrifuging in an appropriate control mode. The two steps can be continuously operated, which greatly simplifies sample preparation process and greatly improves efficiency. Since the type of the motor 31 is not limited in the process, the motor 31 can be ensured to provide high load and high rotational speed at the same time. Therefore, the effects of the oscillation and centrifugation will be greatly improved, and the requirements for the preparation of the sample are satisfied. Moreover, since no special motor is required, the reliability of the device is significantly increased, maintenance costs significantly reduced, which are other important advantages of the disclosed structure.

DETAILED DESCRIPTION OF IMPLEMENTATIONS

Implementation Example

Figure 1:
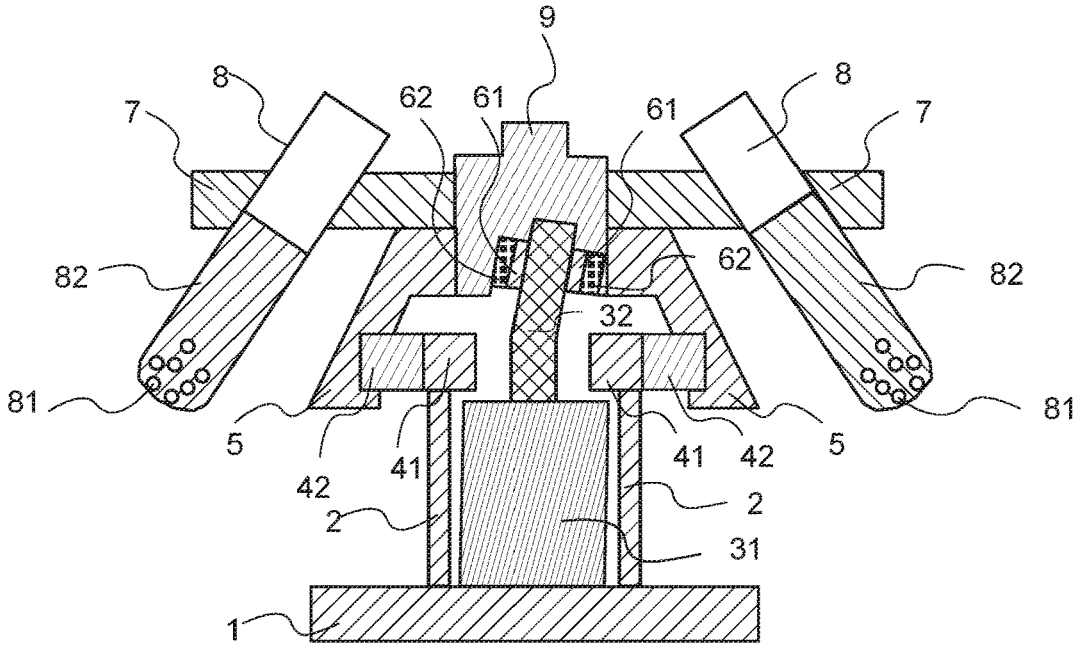
FIG. 1 is a schematic diagram of an oscillation coupling centrifuge in accordance with the present invention, which includes a base 1, a synchronous fixed ring 2, a motor 31, an eccentric shaft 32, a synchronous unidirectional bearing inner ring 41, a synchronous unidirectional bearing outer ring 42, an eccentric unidirectional bearing inner ring 61, an eccentric unidirectional bearing outer ring 62, a sample tray 7, sample tubes 8, samples 81, extracts 82, and an eccentric sleeve 9.
Figure 2:
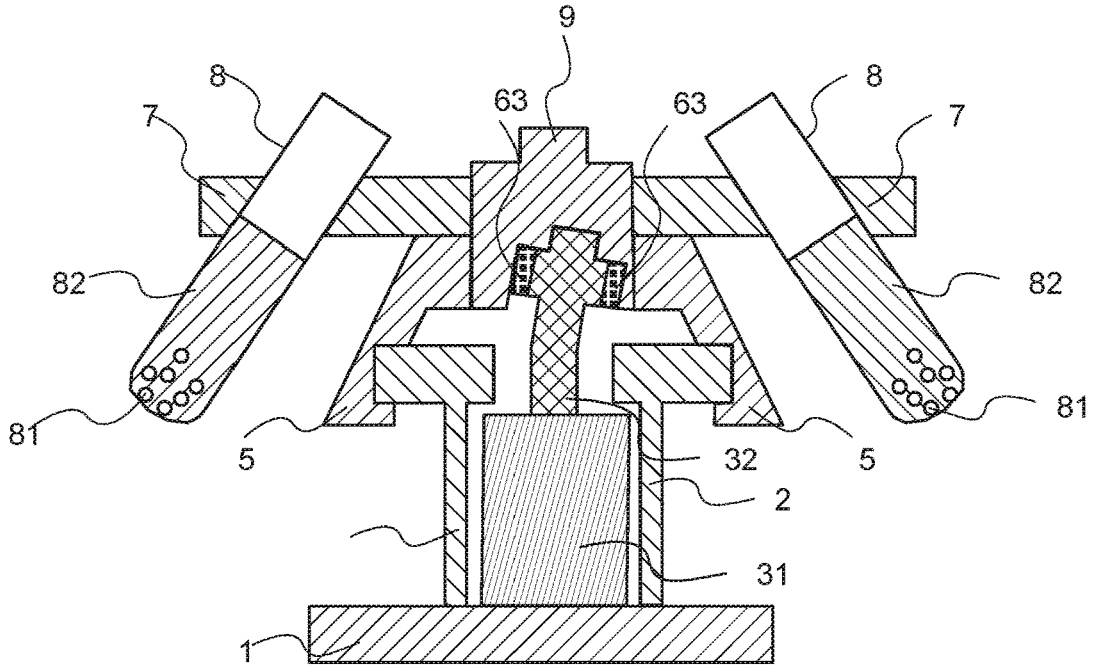
FIG. 2 is a schematic rotation equivalent diagram of the oscillation coupling centrifugal device along direction A, which includes a base 1, a synchronous fixed ring 2, a motor 31, an eccentric shaft 32, an elastic connection body 5, an equivalent eccentric coupling bearing 63, a sample tray 7, sample tubes 8, samples 81, extracts 82, and an eccentric sleeve 9.
Figure 3:
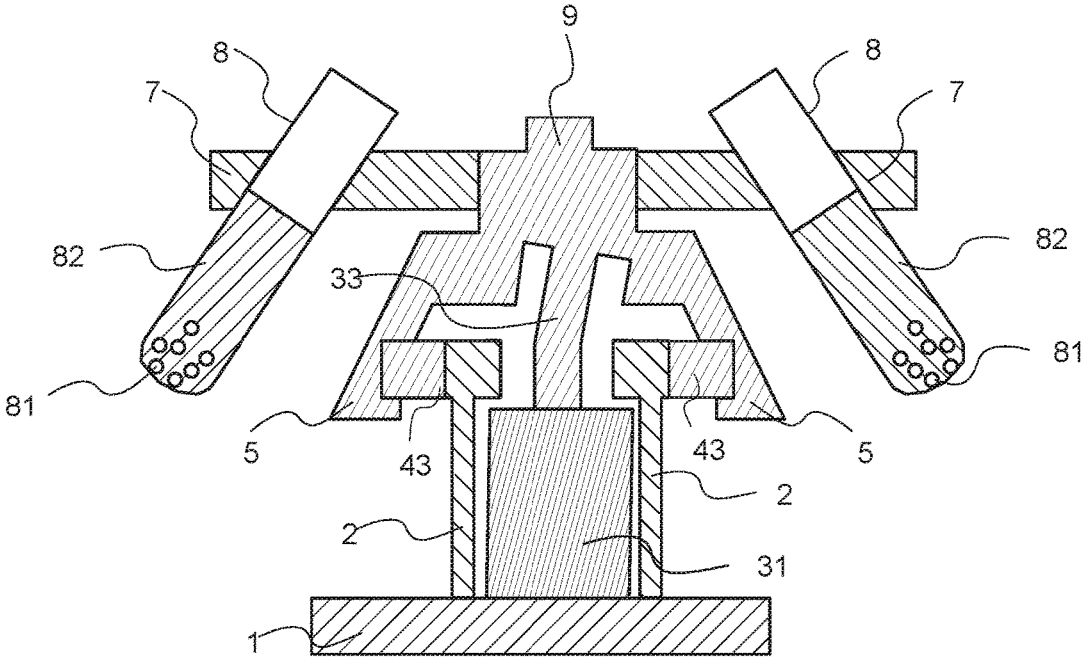
FIG. 3 is a schematic rotation equivalent diagram of the oscillation coupling centrifugal device along a direction opposite to direction A, which includes a base 1, a synchronous fixed ring 2, a motor 31, an equivalent shaft coupling body 33, an equivalent synchronous coupling bearings 43, a sample tray 7, sample tubes 8, samples 81, extracts 82, and an eccentric sleeve 9.

Chicken samples each weighted 2.0±0.05 g (accurate to 0.01 g) is placed in the 50 mL centrifuge tube, and are respectively added with appropriate amounts of Amantadine, D15-amantadine, Rimantadine, D4-rosin ethylamine, Chlorpheniramine, D4-chlorobenzene standard working solution, mixed, and let stand for 30 min (using oscillation coupling centrifugation method, directly placing the samples into the 50 mL centrifuge tubes in the outer tube and introducing the standard working solution). Blank samples and samples oscillatory coupling added with 20 μg/L of above described chemicals are respectively prepared in parallel. Both blank samples and the samples added with the chemicals are treated using the following two methods. The samples are then analyzed using machines specified in the national standards for food safety "animal-derived food Amantadine and Rimantadine residues Determination of Liquid Chromatography—Tandem Mass Spectrometry".

(1) Manual treatment method: adding 20 mL of 1% acetic acid acetonitrile solution, whirlpool oscillation for 3 min, adding 2 g of anhydrous magnesium sulfate, vortex for 30 s, centrifuge at 4000 r/min for 5 min. Take 1 mL of the supernatant, add 50 mg of PSA, vortex for 30 s, and centrifuge at 4000 r/min for 3 min. The resulting supernatant was filtered with a 0.22 μm filter and measured with LC-MS/MS.

(2) Automatic treatment method: add 2 g of anhydrous magnesium sulfate and 20 mL of 1% acetic acid acetonitrile into the 50 mL sample tube in the centrifuge tube, mix; add 150 mg of PSA into the inner tube, the inner tube inserted into the outer tube, then placed them in the centrifuge. Program 1 setting: clockwise rotation to achieve 8-shaped oscillation for 2 min, and then counterclockwise rotation to centrifuge at 5000 rpm for 3 min. Program 2 setting: clockwise rotation to achieve 8-shaped oscillation for 1 min, and then counterclockwise rotation to centrifuge at 500 rpm for 2 min. Run the two programs. After completion, the resulting supernatant was filtered with a 0.22 μm filter and measured with LC-MS/MS.

TABLE 1

Results of Amantadine in chicken obtained by different sample preparation methods

| | | | External standard method (n = 3) | | | Internal standard method (n = 3) | | |
|---|---|---|---|---|---|---|---|---|
| Order No. | Chemical | Treatment Method | Matrix Effect | Recovery Rate | RSD % | Matrix Effect | Recovery Rate | RSD % |
| 1 | Amantadine | Manual | 2.59 | 95% | 10 | 1.08 | 113% | 3.1 |
| 2 | | Automatic | 2.4 | 96% | 5.4 | 0.94 | 106% | 2.3 |
| 3 | Comparison Result | Manual/ Automatic | 1.07 | 0.98 | 1.85 | 1.14 | 1.06 | 1.34 |
| 4 | Amantadine | Manual | 1.36 | 75% | 8 | 1.04 | 99% | 3.5 |
| 5 | | Automatic | 1.1 | 96% | 4.1 | 1.06 | 103% | 1.9 |
| 6 | Comparison Result | Manual/ Automatic | 1.23 | 0.78 | 1.95 | 0.98 | 0.96 | 1.84 |

From the above table we can see that there is no significant difference in the matrix effect between the two methods for Amantadine; based on the external standard method, the absolute recovery rate by the oscillation coupling centrifugation method is basically the same as that of the manual treatment method, both being above 95%. Based on the internal standard method, the automatic method and manual treatment method can obtain relatively good recovery rates and accurate results. For Amantadine, there is no significant difference in the matrix effects between the two methods. Based on the external standard method, the difference in absolute recovery rates between the manual treatment and the oscillation coupling centrifugation method is not significant, both being above 75%, whereas the internal standard method can obtain relatively better recovery rates and more accurate results. According to the isotope internal standard method adopted in the draft version of the national standard for food safety titled "Determination of Amantadine residues in animal food by liquid chromatography—tandem mass spectrometry", the present experiments can produce similar results using the disclosed sample oscillation coupling centrifugal treatment method and manual treatment method.

What is claimed is:

1. An analytical sample preparation device, comprising:

a base (1);

an elastic connection body (5);

a group of a synchronous unidirectional bearing inner ring (41) and a synchronous unidirectional bearing outer ring (42);

a group of an eccentric unidirectional bearing inner ring (61) and an eccentric unidirectional bearing outer ring (62); and a synchronous fixed ring (2) and a motor (31) on the base (1), wherein the motor (31) is positioned within the synchronous fixed ring (2), wherein one end of the synchronous fixed ring (2) is fixed to the synchronous unidirectional bearing inner ring (41), wherein the synchronous unidirectional bearing outer ring (42) is connected to a lower end of the elastic connection body (5), wherein the eccentric unidirectional bearing inner ring (61) is connected with an eccentric shaft (32) extending from the motor (31), wherein the eccentric unidirectional bearing outer ring (62) is fixed to an eccentric shaft sleeve (9) that is fixed to a sample tray (7) and an upper end of the elastic connection body (5), wherein the eccentric shaft sleeve (9), the eccentric shaft (32), the eccentric unidirectional bearing inner ring (61), and the eccentric unidirectional bearing outer ring (62) have their center of mass disposed on a line extended from a center line of the motor (31), wherein the eccentric unidirectional bearing inner ring (61) and the eccentric unidirectional bearing outer ring (62) are configured to only rotate in direction A, wherein the synchronous unidirectional bearing outer ring (41) and the synchronous unidirectional bearing outer ring (42) are configured to only rotate in a direction opposite to direction A.

2. The analytical sample preparation device of claim 1, wherein the eccentric shaft (32) and the line extended from the center line of the motor (31) define an angle from 1° to 10° therebetween.

3. The analytical sample preparation device of claim 1, wherein an upper end of the elastic connection body (5) is connected with a lower end of the eccentric shaft sleeve (9), wherein the sample tray (7) is fixedly connected to the upper end of the eccentric shaft sleeve (9).

4. The analytical sample preparation device of claim 1, wherein direction A is clockwise or counterclockwise.

5. A method for preparing analytical samples using the analytical sample preparation device recited in claim 1, comprising:

1) placing a sample tube containing a sample and an extract into the sample tray (7);

2) setting the motor (31) to rotate in direction A for a first predetermined time, wherein the motor (31) drives the eccentric unidirectional bearing inner ring (61) to rotate relative to the eccentric unidirectional bearing outer ring (62), which causes the elastic connection body (5) to drive the sample tube to oscillate, thereby achieving extraction of the sample by vibration; and 3) when the vibration is finished, setting the motor (31) to rotate in the direction opposite to direction A for a second predetermined time, wherein the motor (31) drives the synchronous unidirectional bearing inner ring (41) to rotate relative to the synchronous unidirectional bearing outer ring (42), which causes the elastic connection body (5) to drive the sample tube to rotate, thereby achieving separation of the sample from the extract in the sample tube.

6. The method of claim 5, further comprising:

adjusting the first predetermined time and the second predetermined time; and repeating step 2) and step 3) one or more times to achieve separation of the sample from the extract in the sample tube.

7. The method of claim 5, further comprising: placing a plurality of sample tubes symmetrically on the sample tray.

* * * * *